US010537925B2

(12) United States Patent
Klingesberger et al.

(10) Patent No.: US 10,537,925 B2
(45) Date of Patent: Jan. 21, 2020

(54) SHEET METAL BENDING MACHINE

(71) Applicant: SALVAGNINI ITALIA S.P.A., Sarego (VI) (IT)

(72) Inventors: Johann Klingesberger, Ottensheim (AT); Wolfgang Kunze, Leonding (AT); Reinhard Hochwallner, Haag (AT)

(73) Assignee: SALVAGNINI ITALIA S.P.A., Sarego (IT)

( * ) Notice: Subject to any disclaimer, the term of this patent is extended or adjusted under 35 U.S.C. 154(b) by 619 days.

(21) Appl. No.: 15/306,922

(22) PCT Filed: Apr. 28, 2015

(86) PCT No.: PCT/EP2015/059158

§ 371 (c)(1),
(2) Date: Oct. 26, 2016

(87) PCT Pub. No.: WO2015/165883

PCT Pub. Date: Nov. 5, 2015

(65) Prior Publication Data

US 2017/0043385 A1 Feb. 16, 2017

(30) Foreign Application Priority Data

Apr. 30, 2014 (EP) ..... 14166583

(51) Int. Cl.
*B21D 5/02* (2006.01)
*B21D 5/04* (2006.01)
(Continued)

(52) U.S. Cl.
CPC ..... *B21D 5/0254* (2013.01); *B21D 5/002* (2013.01); *B21D 5/0218* (2013.01); *B21D 5/04* (2013.01); *B21D 37/14* (2013.01)

(58) Field of Classification Search
CPC ..... B21D 5/0254; B21D 5/04; B21D 5/004; B21D 37/14; B21D 5/0218; B21D 5/002
(Continued)

(56) References Cited

U.S. PATENT DOCUMENTS 4,656,861 A * 4/1987 Koyama ..... B21D 5/0254 483/29
4,660,402 A * 4/1987 Hongo ..... B21D 5/02 72/319

(Continued)

FOREIGN PATENT DOCUMENTS

CN 1402657 3/2003
CN 101065197 10/2007

(Continued)

OTHER PUBLICATIONS

International Search Report dated Jul. 17, 2015 in International (PCT) Application No. PCT/EP2015/059158.

*Primary Examiner* — David B Jones
(74) *Attorney, Agent, or Firm* — Wenderoth, Lind & Ponack, L.L.P.

(57) ABSTRACT

A sheet metal bending machine comprises main bending tool assembly (2; 6) that extends along a longitudinal direction (A) and is movable so as to bend a workpiece (50), a guide (3) associated and parallel to the main bending tool assembly (2; 6), extending through a working zone (W) of the bending machine (1) and sideways protruding from the latter at least with a first end portion (4), and shuttles (21, 22, 23) slidably mounted on said guide (3) and supporting at least one auxiliary tool (41, 42) to be associated with the main bending tool assembly (2; 6) in order to execute partial bends on the workpiece (50); the shuttles (21, 22, 23) are movable along the longitudinal direction (A) between a first active position (P1), in which the shuttle (21, 22, 23) are inside the working zone (W) and the auxiliary tool (41, 42)
(Continued)

is mounted on the main bending tool assembly (2; 6), and a first inactive position (R1), in which the shuttle (21, 22, 23) are outside the working zone (W) and positioned at the first end portion (4) of the guide (3); the shuttle comprise a first set (11) of shuttles (21, 22, 23), each shuttle (21, 22, 23) carrying a respective auxiliary tool (41, 42), said shuttles (21, 22, 23) being mutually connectable to form a first shuttle convoy (13) having a selectable number of shuttles (21, 22, 23); the first shuttle convoy (13) is movable between said first inactive position (R1) and said first active position (P1) in order to mount a defined composition of auxiliary tools (41, 42) on the main bending tool assembly (2; 6).

20 Claims, 10 Drawing Sheets

(51) Int. Cl.
*B21D 37/14* (2006.01)
*B21D 5/00* (2006.01)

(58) Field of Classification Search
USPC ..... 72/389.1
See application file for complete search history.

(56) References Cited

U.S. PATENT DOCUMENTS 4,680,955 A * 7/1987 Sakamoto ..... B21D 5/02 100/918
4,761,985 A * 8/1988 Klingesberger ..... B21D 5/0236 72/316
5,168,745 A * 12/1992 Miyagawa ..... B21D 5/02 483/29
7,901,341 B2 * 3/2011 Shimizu ..... B21D 5/02 483/29
9,975,161 B2 * 5/2018 Sato ..... B21D 5/004
2003/0005744 A1 1/2003 Gasparini
2003/0064871 A1 * 4/2003 Akami ..... B21D 5/02 483/1
2009/0114703 A1 5/2009 Bruggenbrock et al.
2014/0090442 A1 * 4/2014 Kunze ..... B21D 5/045 72/452.1
2015/0174633 A1 * 6/2015 Sato ..... B21D 5/004 483/1
2017/0043385 A1 * 2/2017 Klingesberger ..... B21D 5/0254
2017/0320123 A1 * 11/2017 Cavicchia ..... B21D 5/0236

FOREIGN PATENT DOCUMENTS

| | | |
|---|---|---|
| CN | 201161260 | 12/2008 |
| EP | 0 925 126 | 4/2000 |
| EP | 1 797 973 | 6/2007 |
| EP | 2 719 476 | 4/2014 |
| JP | 6-190448 | 7/1994 |
| JP | 7-112215 | 5/1995 |
| JP | 8-309438 | 11/1996 |
| JP | 2001-150032 | 6/2001 |

* cited by examiner

Fig. 6
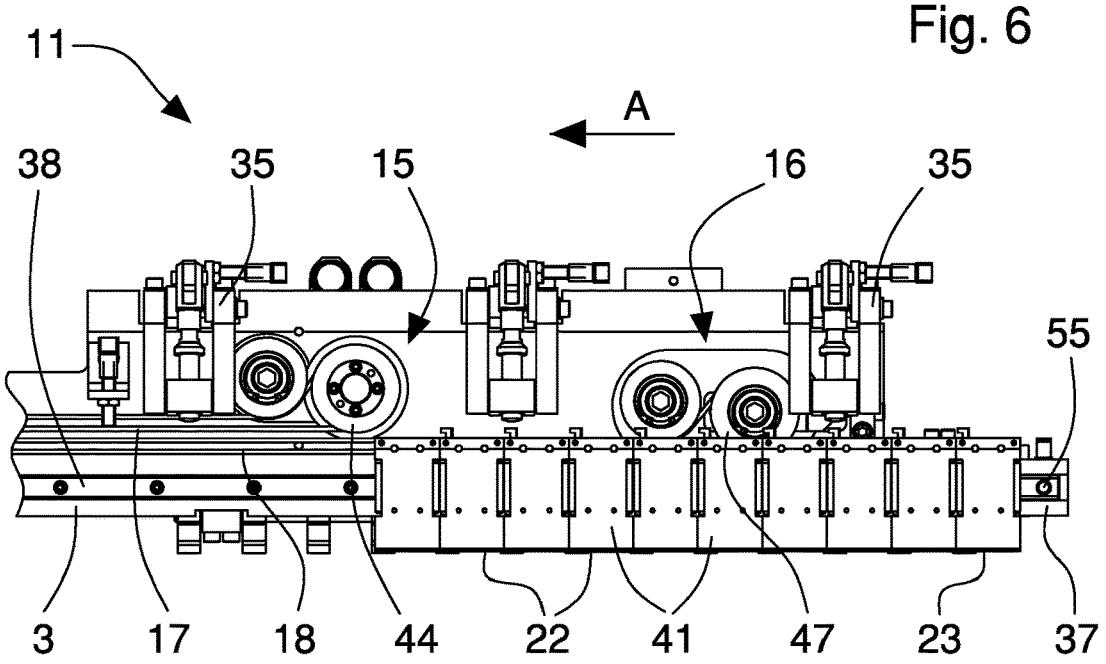
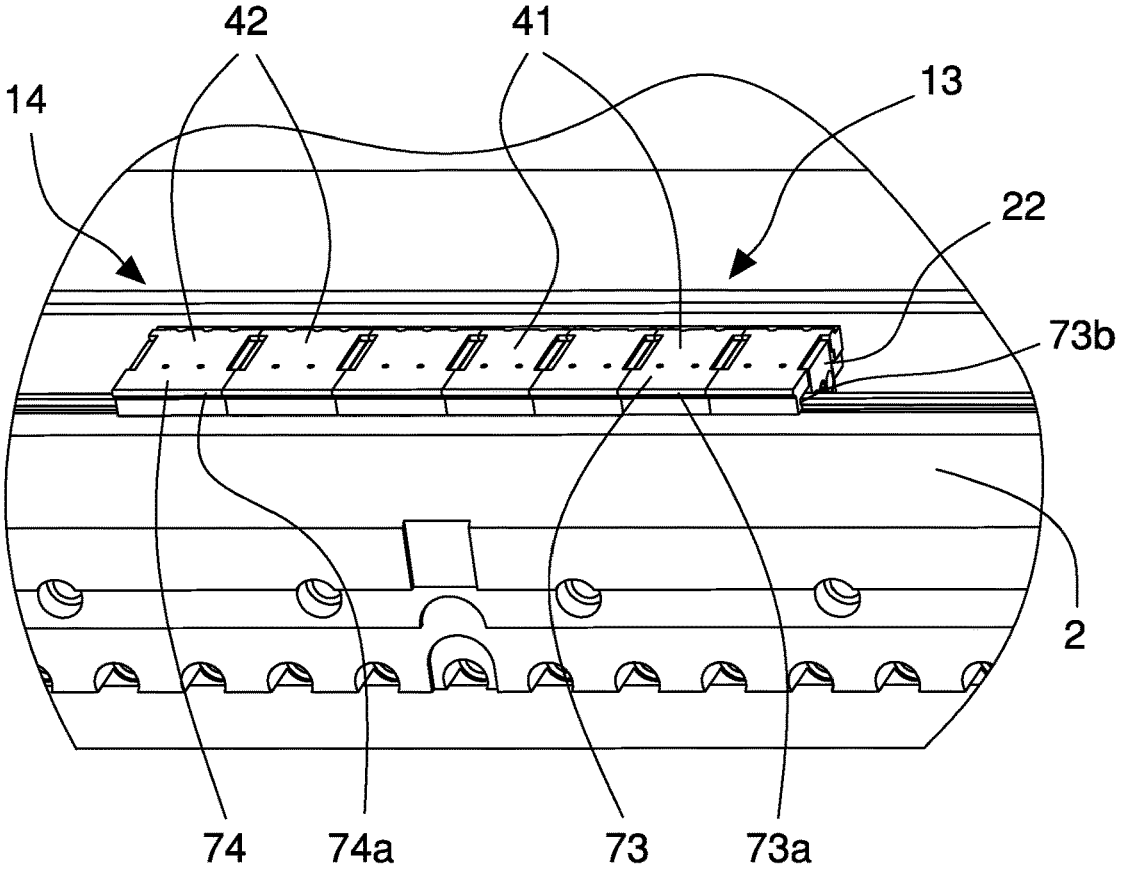
Fig. 5

Fig. 18
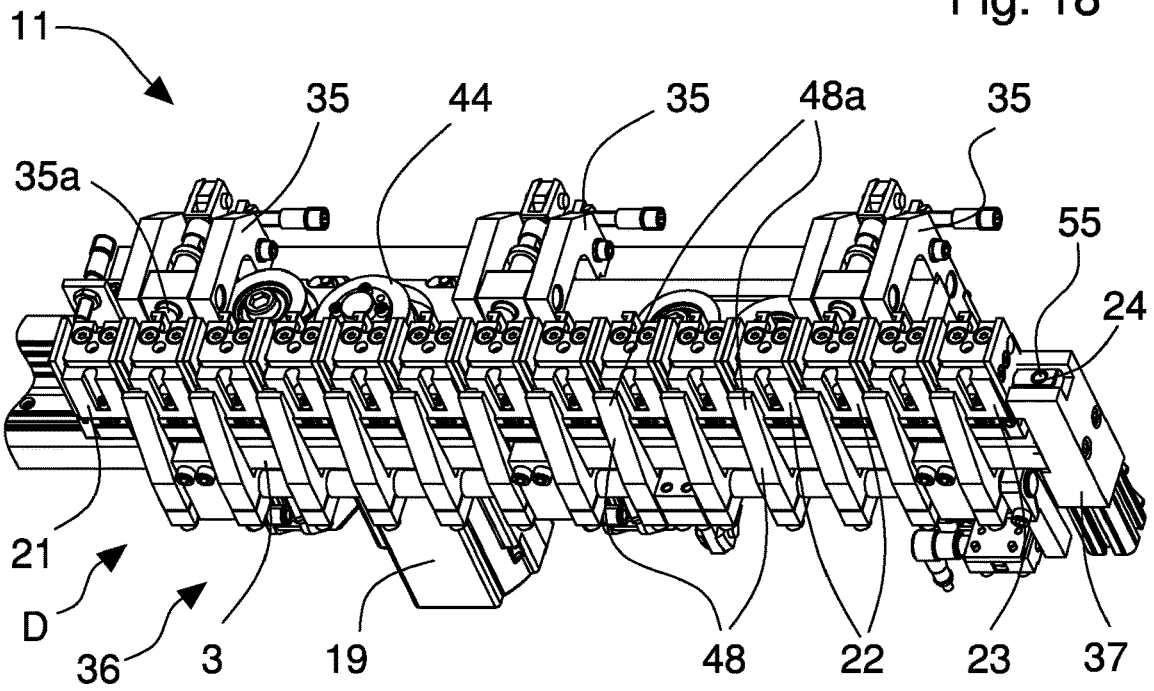
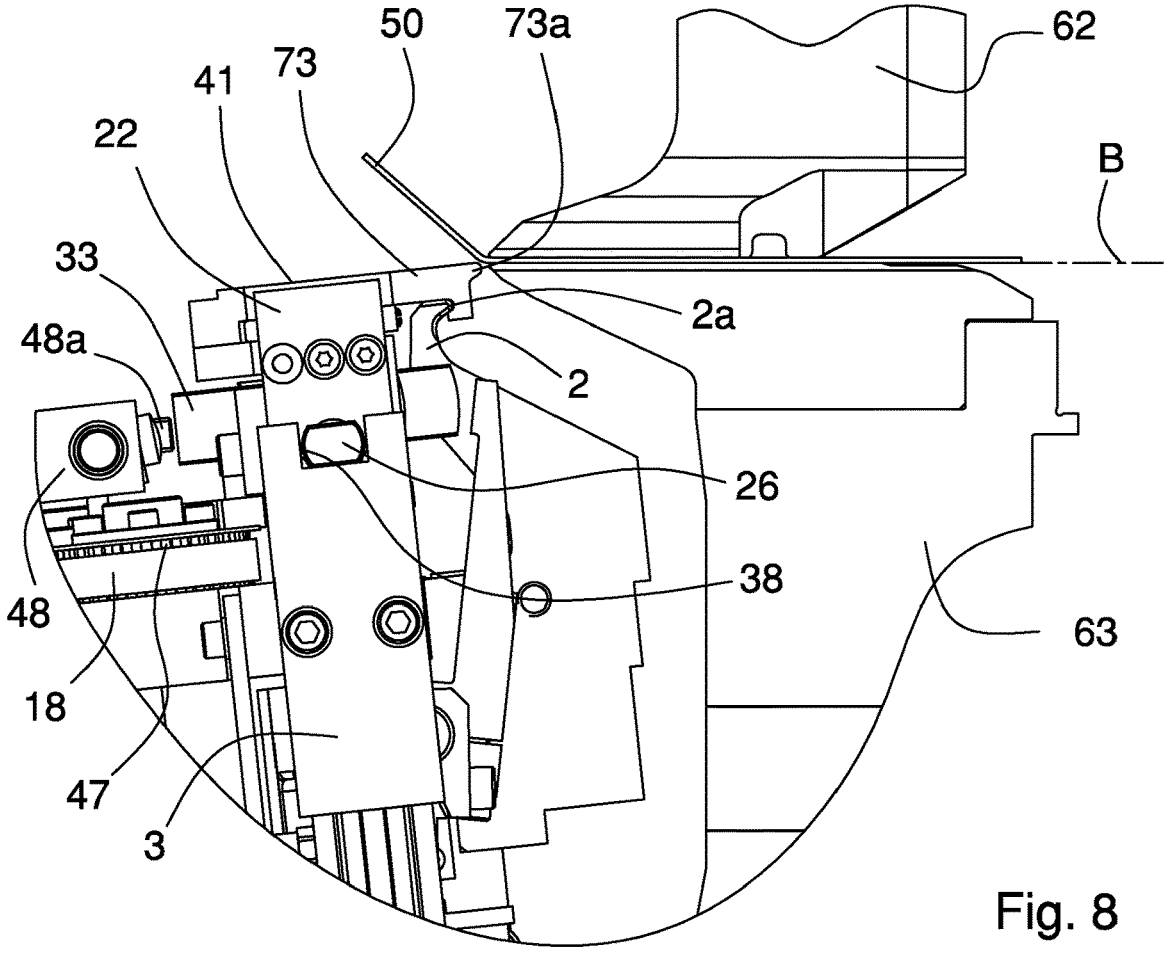
Fig. 8

Fig. 12
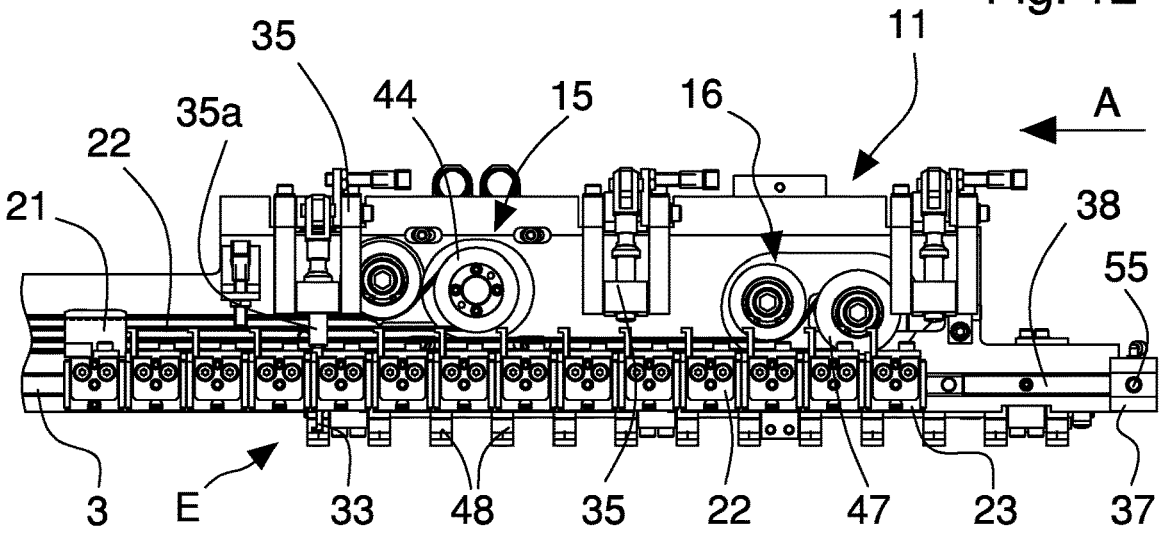
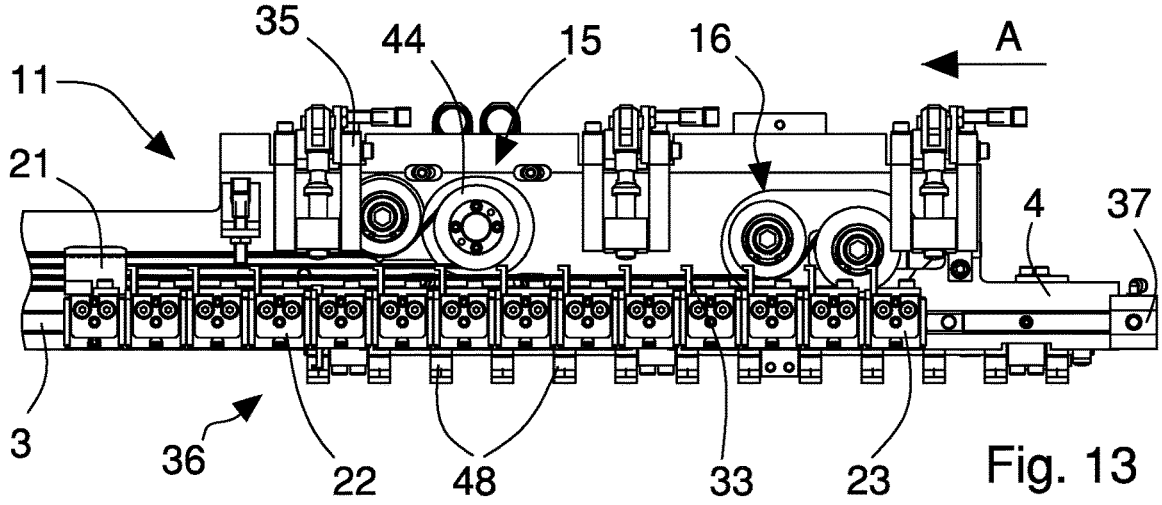
Fig. 13
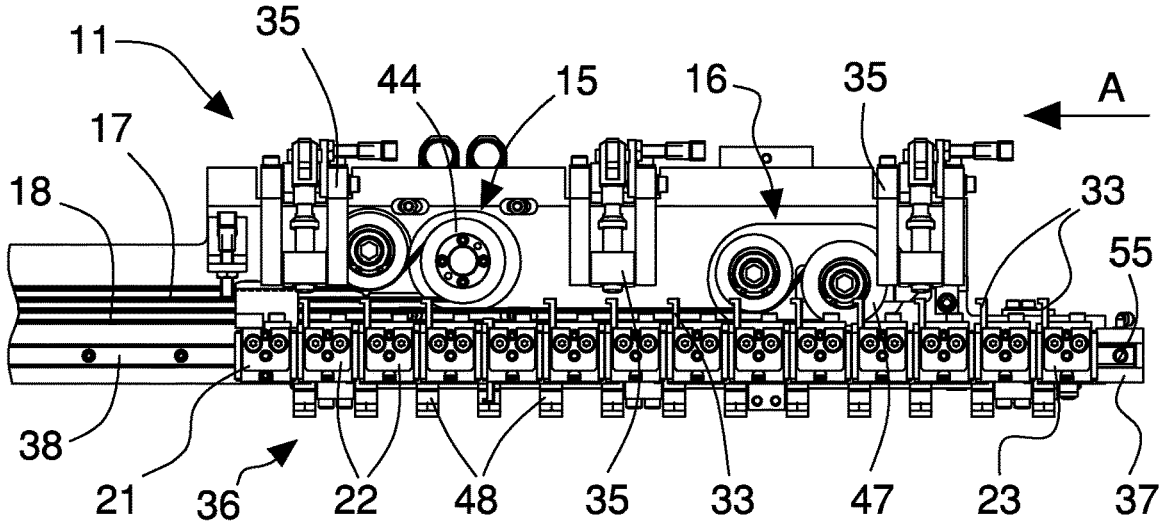
Fig. 14

SHEET METAL BENDING MACHINE

The invention relates to bending machines arranged for bending or folding metal strips, sections, plates and sheets in order to manufacture semi-finished and/or finished products. In particular, the invention relates to a bending machine provided with a system for automatically mounting or dismounting auxiliary or extra bending tools suitable for executing partial bends on a workpiece.

The known bending machines or press brakes comprise a mechanical, hydraulic, pneumatic or servo-electric operated press that vertically moves an upper tool or punch against a lower tool or die so as to deform a workpiece that is inserted between the tools. The upper punch exerts on the workpiece a force that deforms and bends the latter according to an angle defined by the tool shape. The lower die is fixed to a machine frame and comprises a longitudinal opening or channel that cooperates with the upper punch for bending the workpiece.

The upper punch may include a linear bending blade that deforms the workpiece along a folding line. The punch is linearly moved along a vertical direction or can rotate around a horizontal axis. The workpiece is fixed and tightened on a machine worktable by suitable clamping means.

Some bending machines are equipped with a movable lower die that comprises a respective linear bending blade which moves together with the upper punch for bending the workpiece. The upper punch and the lower die can also operate independently and separately so as to deform the workpiece along respective bending lines at different operative steps.

In order to partially bend the workpiece, specifically in order to execute folds having lengths shorter than the workpiece dimensions (width) such as small flaps, tabs and the like, auxiliary or extra bending tools have to be mounted on the bending blade which abut on and bend the workpiece instead of the bending blade. The number and the size (width) of the extra bending tools (tool composition or configuration or arrangement) are selected according to the folding length to be carried out. The sizes of the auxiliary tools are standardized, thus usually, in order to achieve a required length, tools having different size have to be arranged adjacent. The auxiliary tools have to be precisely positioned along the bending blade in order to correctly interact with the workpiece.

There are known bending machines wherein the auxiliary tools are manually mounted on the bending blade, such manual operations having the drawback of requiring a skilled operator and time. In fact, in order to mount or dismount the auxiliary tools, the bending machine has to be stopped for a quite long time, thus interrupting the production and consequently decreasing the machine output. Furthermore, the auxiliary tools can be mounted/dismounted only before starting the workpiece production cycle and not during said production cycle.

Systems for automatically mounting/dismounting the auxiliary tools are known that comprise a carriage supporting the required auxiliary tools and moving along the bending blade. Thus the required auxiliary tools can be quickly and precisely positioned and mounted on the bending blade. Nevertheless, the auxiliary tools have to be manually selected, arranged and fixed to the carriage by an operator, this operation requiring time.

An object of the present invention is to improve the known bending machines for bending metal strip, section, plate and sheet, in particular the known bending machines which can be provided with auxiliary bending tools mounted on a main bending tool for executing partial bends.

Another object is to achieve a bending machine wherein the auxiliary bending tools for partial bends can be automatically, quickly and precisely mounted on and/or dismounted from the main bending tool so as to reduce the machine downtime.

A further object is to achieve a bending machine wherein the auxiliary bending tools required for the partial bends are automatically selected and arranged on the main bending tool.

Another further object is to achieve a bending machine provided with means for positioning the auxiliary bending tools, that has a simple and economical structure and operates in effective and reliable way.

These and other objects are achieved by a bending machine according to the main claim, the dependent claims describing other characteristics of the invention.

The bending machine according to the invention comprises a main bending tool assembly that extends along a longitudinal direction and is movable so as to bend a workpiece, a guide associated and parallel to said main bending tool assembly and shuttles slidably mounted on said guide and supporting at least one auxiliary tool to be associated with the main bending tool assembly in order to execute partial bends on the workpiece. The guide extends through a working zone of the bending machine and sideways protrudes from the latter at least with a first end portion.

The shuttles are movable along the longitudinal direction between a first active position, in which the shuttles are inside the working zone and the auxiliary tool is mounted on the main bending tool assembly, and a first inactive position in which the shuttles are outside the working zone and positioned at the first end portion of the guide. The shuttles comprise a first set of shuttles which carry respective auxiliary tools and are mutually connectable to form a first shuttle convoy having a selectable number of shuttles. The first shuttle convoy is movable between the first inactive position and the first active position in order to mount a defined composition of auxiliary tools on the main bending tool assembly.

The shuttles further comprise a second set of shuttles that carry respective auxiliary tools and are mutually connectable to form a second shuttle convoy having a selectable number of shuttles and movable between a second active position, in which said second shuttle convoy is inside the working zone and the auxiliary tool is mounted on said main bending tool assembly, and a second inactive position, in which said second shuttle convoy is outside the working zone and positioned at a second end portion of the guide that sideways protrudes from the bending machine.

The bending machine also comprises a driving system for moving said shuttles along the guide.

The shuttles support a plurality of auxiliary tools having different respective sizes. In particular, the shuttles of said first set are provided with first auxiliary tools having a first size and the shuttle of said second set are provided with second auxiliary tools having a second size.

The bending machine according to the invention allows automatically, quickly and precisely mounting on and/or dismounting from the main bending tool assembly one or more auxiliary bending tools without requiring any manual operation. In fact, the shuttles carrying the auxiliary bending tools are moved and positioned along the guide associated to the main bending tool assembly by a driving system that is controlled by a control unit of the bending machine. Furthermore, the composition of auxiliary tools to be mounted on the main bending tool assembly is achieved automatically by using a single shuttle convoy or both shuttle convoys.

In fact, a partial bend length can be carried out using one or more first auxiliary tool having a first width and/or one or more second auxiliary tools having a second width. In other words, according to the bending machine of the invention it is possible to set up a desired length of the auxiliary bending tool composition by automatically selecting and arranging the shuttles of the first and second shuttle convoys.

In the bending machine of the invention the auxiliary tools can be mounted and dismounted both automatically and very quickly. Such automatic procedures require a short machine downtime and thus can be performed not only before starting the workpiece production cycle but also during the same production cycle. In other words, a production cycle comprising full length bends and partial bends on the same workpiece can be performed by the bending machine of the invention without reducing the machine output.

These and other characteristics of the invention will be clear from the following description of a preferred embodiment, given as a non-restrictive example, with reference to the attached drawings wherein:

FIG. 5 is another enlarged detail of FIG. 3 showing shuttle convoys carrying auxiliary tools in operating positions;

FIG. 6 is an enlarged detail of FIG. 2 showing the first set of shuttles carrying auxiliary tools;

FIG. 8 shows an enlarged detail of FIG. 7;

FIGS. 11 to 17 shows plan views of the first set of shuttles in respective operative phases;

FIG. 18 is a perspective view of the first set of shuttles of FIG. 17;

Figure 7:
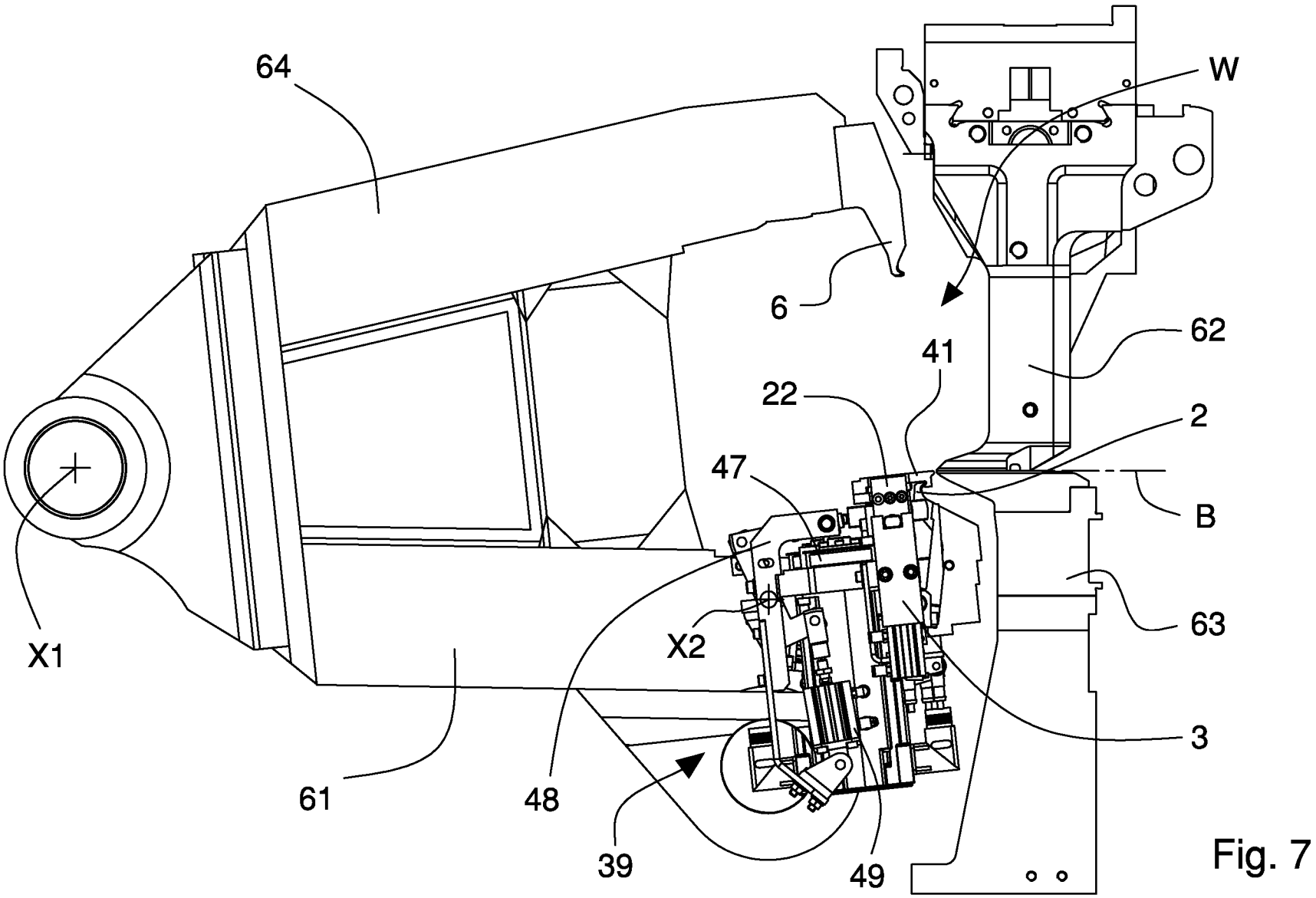
FIG. 7 is a cross section of the machine of FIG. 1.

With reference to FIGS. 1 to 21, a sheet metal bending machine 1 for working sheet metal parts according to the invention comprises a main bending tool assembly 2 that extends along a longitudinal direction A and is movable so as to deform and bend a workpiece 50. In the machine embodiment shown in the figures, the main bending tool assembly 2 comprises a bottom or lower linear bending tool that is hinged by means of a lower support 61 to a frame 68 of the machine 1 and can be rotated around a first axis X1 so as to contact bottom-up a workpiece 50. The axis X1 is horizontal and parallel to the longitudinal direction A. The workpiece 50 is fixed and tightened by clamping means 62, 63. The clamping means comprises an upper clamp 62 that moves vertically against a fixed lower clamp 63 that forms a support surface B for the workpiece 50 (FIG. 7).

The main bending tool assembly 2 and the clamping means 62, 63 define a working area W within which the workpiece 50 is positioned, clamped and then bent.

The bending machine 1 further comprises a top or upper linear bending tool 6 that is substantially opposite to the lower linear bending tool 2 and moves top-down against the workpiece 50. The upper bending tool 6 is hinged by means of an upper support 64 so as to rotate around the first axis X1.

The bending tools 2, 6 extend for the whole bending machine width and execute full length bends on the workpiece 50.

In order to carry out partial bends on the workpiece 50, for example for achieving small flaps, tabs and the like, extra or auxiliary bending tools 41, 42, also known as UC-tools, can be mounted on the main bending tool 2. Said UC-tools abut on and bend the workpiece instead of the main bending tool 2.

The bending machine 1 comprises a guide 3 that is associated and parallel to the main bending tool assembly 2, extends through the working zone W of the bending machine 1 and sideways protrudes from the latter at least with a first end portion 4. In the embodiment shown in the figures, the guide 3 comprises a first end portion 4, for example on the right side of the machine with reference to the front view of FIG. 1, and a second end portion 5 that sideways protrudes from the bending machine 1, for example on the left side of the machine with reference to front view of FIG. 1, and is opposite to said end portion 4.

The guide comprises a guide rail 3 that is associated to the lower bending tool 2 and is coupled to and supported by the lower support 61 thereof. The guide rail 3 is adjacent and parallel to the lower bending tool 2.

Shuttles 21, 22, 23 are provided that are slidably mounted on said guide rail 3 and support at least one auxiliary tool 41, 42 to be associated with the main bending tool assembly 2 in order to execute partial bends on the workpiece 50. The shuttles 21, 22, 23 are movable along the guide rail 3 in the longitudinal direction A between a first active position P1, in which said shuttles 21, 22, 23 are inside the working zone W and the auxiliary tool 40, 41 is mounted on the main bending tool assembly 2 in a required operating position, and a first inactive position R1 in which the shuttles 21, 22, 23 are outside the working zone W and positioned at the end portion 4 of guide rail 3.

The shuttles comprise a first set 11 of shuttles 21, 22, 23 slidably coupled to said guide rail 3, each shuttle 21, 22, 23 of said first set 11 carrying a respective auxiliary tool 41, 42. The shuttles 21, 22, 23 are mutually connectable so as to form a first shuttle convoy 13 that has a selectable number of shuttles 21, 22, 23 and is movable along the guide rail 3 between the first active position P1 and the first inactive position R1.

The shuttles 21, 22, 23 further comprise a second set 12 of shuttles 21, 22, 23, each shuttle 21, 22, 23 of said second set 12 carrying a respective auxiliary tool 41, 42. The shuttles 21, 22, 23 of the second set 12 are mutually connectable to form a second shuttle convoy 14 that has a selectable number of shuttles 21, 22, 23 and is movable along the guide rail 3 between a respective active position P2, wherein said second shuttle convoy 14 is inside the working zone W and the respective auxiliary tools 40, 41 are mounted on the main bending tool assembly 2 (FIGS. 1-3), and a respective inactive position, wherein the second shuttle convoy 14 is outside the working zone W and positioned at the second end portion 5 of the guide rail 3.

Each shuttle 21, 22, 23 comprises a body that has a prismatic shape and is provided on a bottom face with rollers 26 arranged for slidably engaging a longitudinal groove 38 carried out in the guide rail 3. A respective auxiliary tool 41, 42 is fixed on a top face of the shuttle body.

Auxiliary tools 41, 42 of different sizes can be mounted on the shuttles, for example a first auxiliary tool 41 having a first width and a second auxiliary tool 42 having a second width.

In the embodiment of the invention shown in the figures, the shuttles of the first set 11 are provided with the first auxiliary tools 41, while the shuttle of the second set 12 are provided with the second auxiliary tools 42.

Each auxiliary tool 41, 42 comprises an operating part 73, 74 that protrudes from the shuttle body towards the workpiece 50 or the clamping means 62, 63 and includes an operating portion 73*a*, 74*a* for interacting with and deforming the workpiece 50 and a coupling portion 73*b* shaped so as to slidably engage an operating longitudinal portion 2*a* of the lower bending tool 2.

Each set 11, 12 of shuttles 21, 22, 23 comprises, aligned along the moving direction A, starting from an extremity of the respective end portion 4, 5 and directed towards the working zone W, a holding shuttle 23, one or more intermediate shuttles 22, and a driving shuttle 21.

With reference to the machine embodiment shown in the figures, the first set 11 comprises, besides the holding shuttle 23 and the driving shuttle 21, twelve intermediate shuttles 22, while the second set 12 comprises, besides the holding shuttle 23 and the driving shuttle 21, ten intermediate shuttles 22.

The bending machine comprises a driving system 15, 16 for moving the shuttles 21, 22, 23 along the guide 3. In particular, the driving system 15, 16 is coupled to at least one of the shuttles 21, 22, 23 of said set 11, 12.

With particular reference to FIG. 6, the driving system 15, 16 comprises driving belts 17, 18 that are moved by an actuator device 19, 20 and connected to at least one shuttle. More precisely, the belts comprise a first driving belt 17 and a second driving belt 18 that form respective closed loop and are wrapped around respective pulleys 44, 45, 46, 47. The first driving belt 17 is connected to one of the shuttles of the first set 11, in particular to the driving shuttle 21 of the first set 11. The second driving belt 18 is connected to one of the shuttles of the second set 13, in particular to the driving shuttle 21 of the second set 13.

The first driving belt 17 is wrapped around a first driving pulley 44 and a first driven pulley 45 that are rotatably mounted on the guide rail 3 and arranged at opposite end portions 4, 5 thereof. The first driving pulley 44 is driven by a first actuator 19 so as to move the first driving belt 17 and the respective driving shuttle 21 of the first shuttle convoy 13 along the guide rail 3. The first actuator 19 is fixed to the guide rail 3 at the first end portion 4.

The second driving belt 18 is wrapped around a second driving pulley 46 and a second driven pulley 47 that are rotatably mounted in the guide rail 3 and arranged at opposite end portions 4, 5 thereof. The second driving pulley 46 is driven by a second actuator 20 so as to move the second driving belt 18 and the respective driving shuttle 21 of the second shuttle convoy 14 along the guide rail 3. The second actuator 20 is fixed to the guide rail 3 at the second end portion 5.

Each shuttle 21, 22, 23 comprises a connecting assembly 31, 32, 33 for engaging or disengaging a respective connecting assembly 31, 32, 33 of an adjacent shuttle 21, 22, 23 so as to mutually connect or disconnect the shuttles 21, 22, 23 and form the first or second shuttle convoy 13, 14 having the required number of shuttles, namely the required number of auxiliary tools to be mounted on the main bending tool 2.

It should be noted that each shuttle convoy 13, 14 can comprise at least the driving shuttle 21 carrying the respective auxiliary tool 41, 42.

Locking/unlocking units 35, 36 are associated to the guide rail 3 for selectively acting on the connecting assembly 31, 32, 33 of the shuttles 21, 22, 23 in order to connect or disconnect the shuttles 21, 22, 23.

Figure 15:
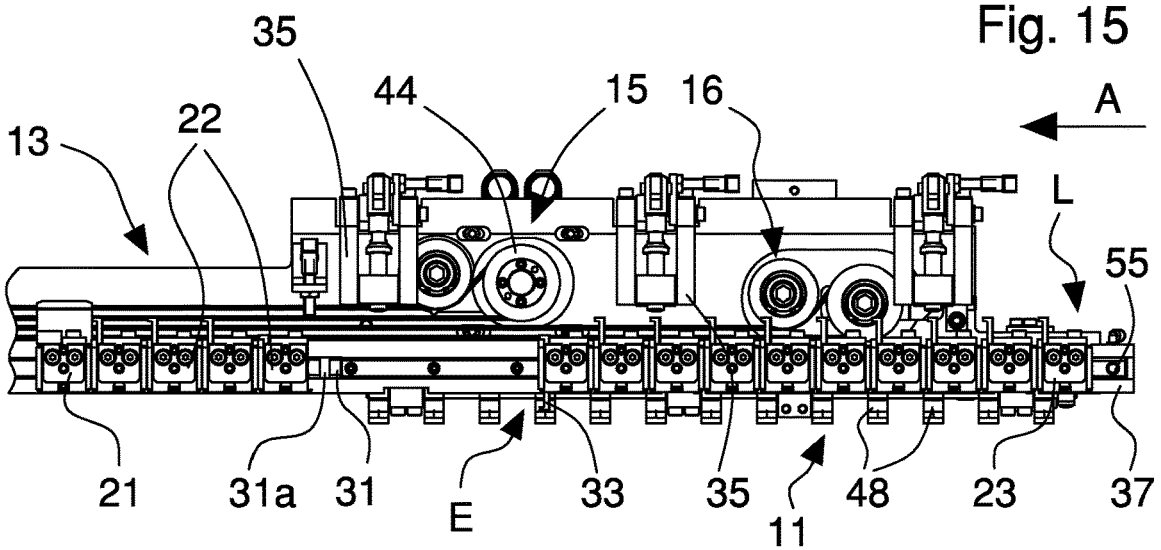
Figure 20:
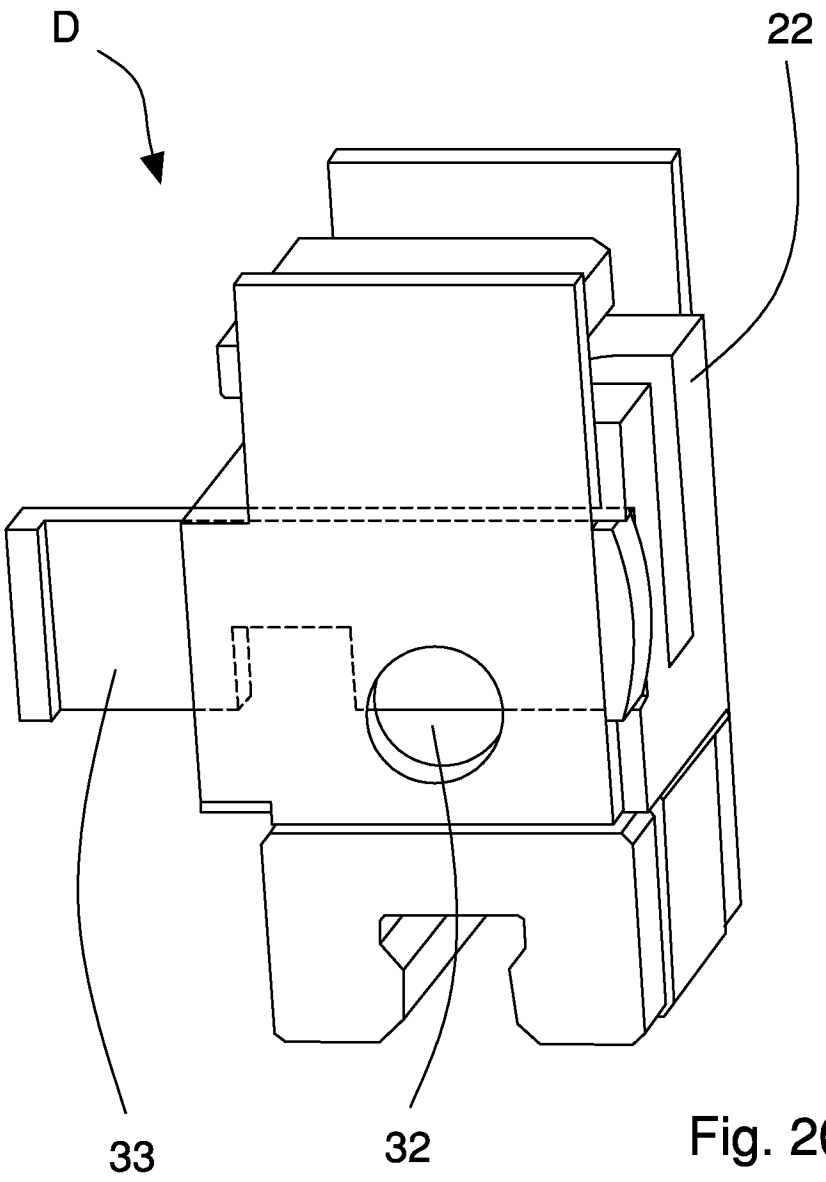
FIGS. 19 and 20 are perspective views of a shuttle showing a connecting assembly thereof in disengaged position and engaged position respectively.
Figure 19:
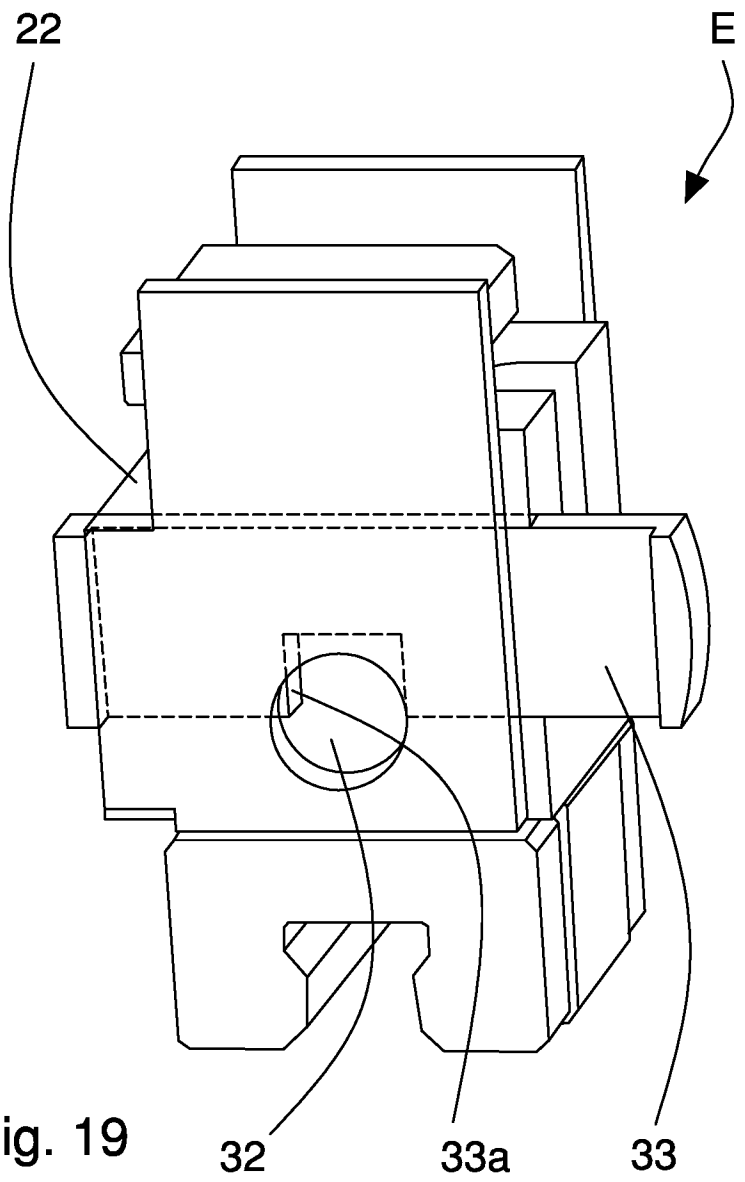
Figure 21:
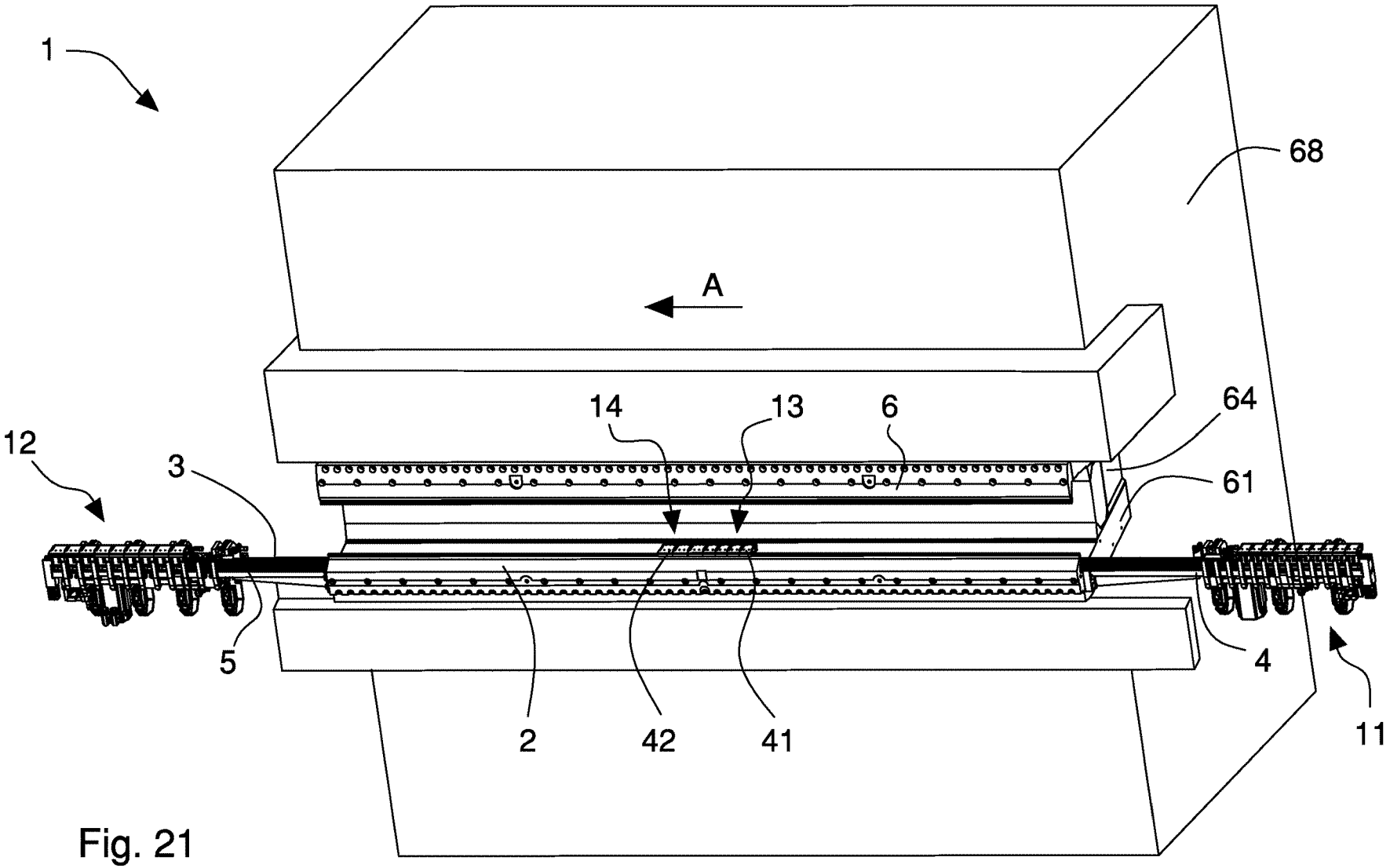
FIG. 21 is a schematic perspective view of the bending machine according to the invention in an operative configuration.

With reference to FIGS. 15, 19 and 20, the connecting assembly comprises a connecting pin 31 protruding from a side of the respective shuttle 21, 22, 23, a connecting cavity 32 carried out on the opposite side of the shuttle 21, 22, 23 and arranged for receiving a locking pin 31 of an adjacent shuttle 21, 22, 23 and a locking element 33 slidably associated to the connecting cavity 32 and selectively movable so as to engage or disengage the connecting pin 31 when the latter is inserted in the connecting cavity 32.

The connecting pin 31 is parallel to the longitudinal direction A and comprises a transversal notch 31*a* that can be engaged by the locking element 33 in a locking position D. The locking element 33 includes a slider that transversally slides through the shuttle body for engaging the transversal notch 31*a* of the connecting pin 31 of an adjacent shuttle in the locking position D (FIG. 20). The locking element 33 has an opening 33*a* that enables the locking element 33 and the connecting pin 31 to be disengaged in an unlocking position E (FIG. 19). When the locking element 33 is in the unlocking position E, the connecting pin 31 of a shuttle can be removed from, or inserted into, the connecting cavity 32 of the adjacent shuttle.

The locking element 33 is transversally moved, in particular orthogonally to the longitudinal direction A by the locking/unlocking units 35, 36.

The locking/unlocking units 35, 36 comprise one or more unlocking units 35, for example three, that are fixed to each end portion 4, 5 of the guide rail 3 and are arranged for moving the locking element 33 of a defined shuttle in the respective unlocking position E (FIG. 12). Each unlocking unit 35 comprises a respective first linear actuator, for example a pneumatic cylinder, having an operative end 35*a* that pushes the locking element 33 from the locking position D to the unlocking position E.

Thanks to the plurality of unlocking units 35 that are spaced apart along each end portion 4, 5 of the guide rail 3 it is possible to compose a shuttle convoy 13, 14 having the desired number of shuttles without occupying the working area W. In other words, the shuttles of each set 11, 12 remain in the end portion 4, 5 of the guide rail 3 for the composition of the shuttle convoy while the bending machine 1 works, the main bending tool 2 deforming the workpiece 50 in the working area W.

The locking/unlocking units further comprise locking units 36 that are fixed to the end portions 4, 5 of the guide rail 3 and are arranged for moving and maintaining the locking element 33 of shuttles 21, 22, 23 in the locking position D. In particular, each locking unit 36 comprises a plurality of locking levers 48 rotating together around a second axis X2 that is horizontal and parallel to the longitudinal direction A so as to push by means of respective unlocking ends 48*a* the locking elements 33 from the unlocking position E to the locking position D (FIG. 8). The levers 36 are rotated around the second axis X2 by moving means 39 comprising, for example, one or more pneumatic cylinders 49.

The bending machine 1 further comprises holding devices 37 that are fixed to said guide rail 3 at said end portion 4, 5 and are arranged for blocking at least one of said shuttles 21, 22, 23 to the guide rail 3. More precisely, holding devices comprise two holding units 37 fixed to both extremities of the end portions 4, 5 and acting on the holding shuttle 23 of each set 11, 12 of shuttles 21, 22, 23. Each holding unit 37 comprises a holding pin 55 driven by a second linear actuator 56 so as to selectively engage or disengage a seat 24 of the holding shuttle 23. When the holding pin 55 engages the seat 24, the holding shuttle 23, and thus all the shuttle 22, 21 connected thereto, is fixed to the guide rail 3 in a locked position L.

A control unit of the bending machine 1, which is known and not shown in the figures, controls the operation of driving system 15, 16, locking/unlocking units 35, 36 and holding devices 37 in order to compose a shuttle convoy 13, 14 having the required number of shuttles and to move said shuttle convoy 13, 14 inside the bending machine 1 for positioning the auxiliary tools 41, 42.

The bending machine 1 as described heretofore functions as follows.

Figure 9:
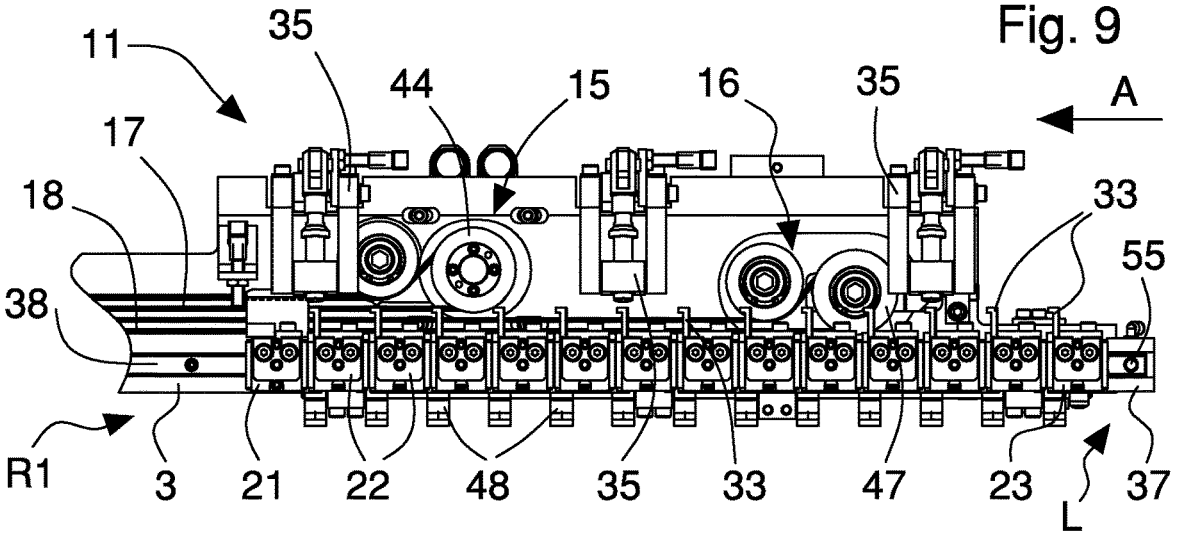
FIGS. 9 and 10 are respectively a plan view and a perspective view of the first set of shuttles in an inactive position.
Figure 10:
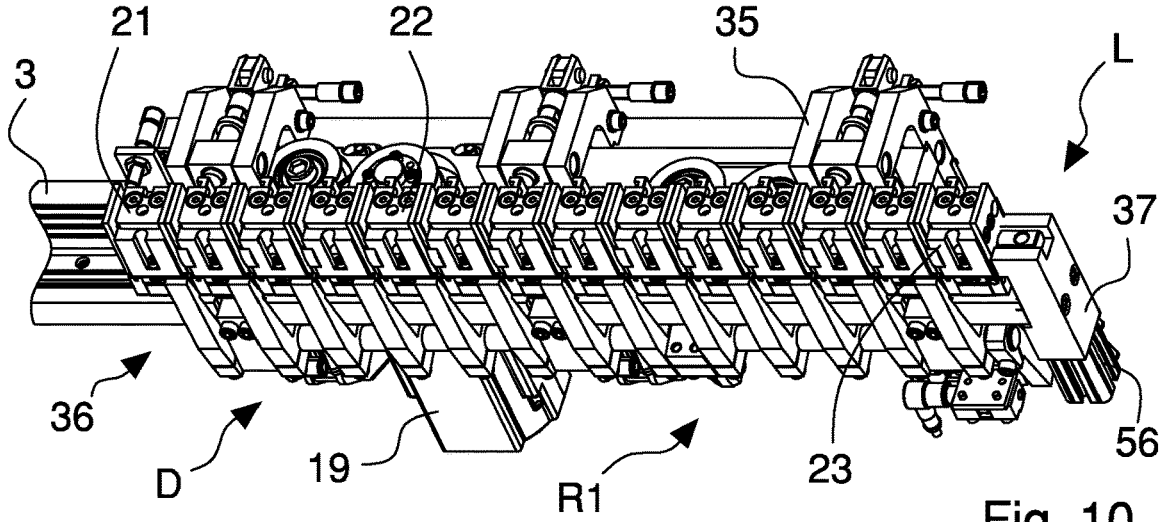
Figure 11:
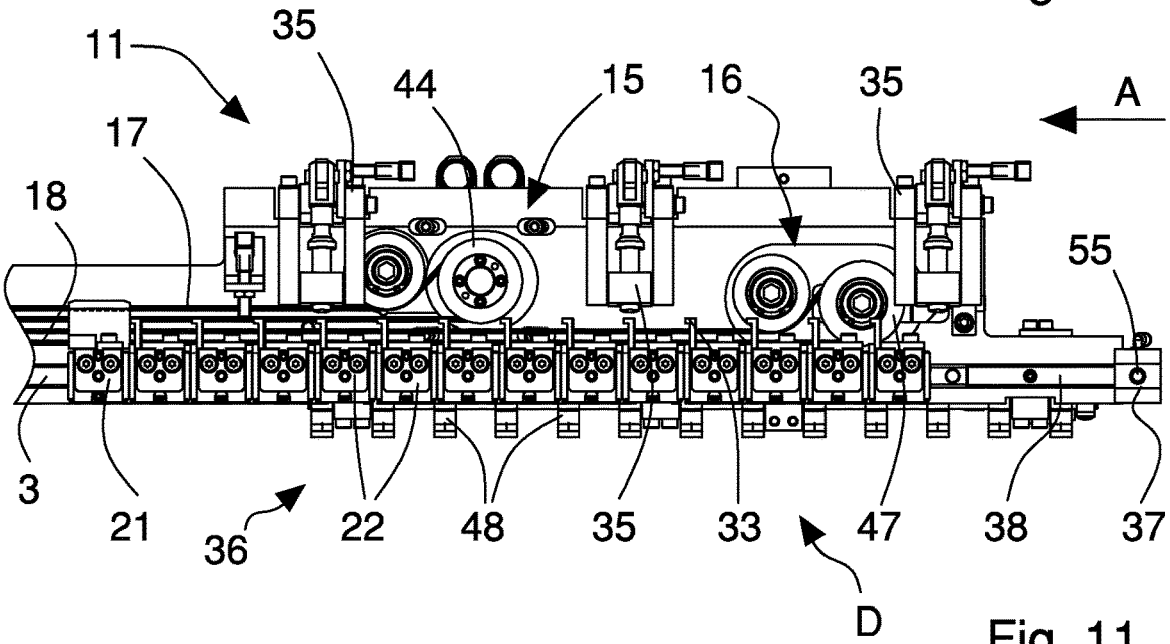

At the beginning of an operation cycle the set 11, 12 of the shuttle 21, 22, 23 are in a starting configuration wherein all the shuttles of each set 11, 12 are connected together and positioned at the end portions 4, 5, the respective holding shuttle 23 blocked by the holding units 37 in the locked position L (FIGS. 9 and 10).

When a composition of auxiliary tools 41, 42 is required for executing a partial bend having a defined length on the workpiece 50, the holding units 37 release the holding shuttles 23 and the driving system 14, 15 moves all the shuttles 21, 22, 23 of the set 11, 12 in a defined detaching position (FIG. 11) along the guide rail 3 wherein a defined unlocking unit 35 acts on the connecting assembly 31, 32, 33 of a defined shuttle 21, 22, 23 in order to disconnect the shuttle convoy 13, 14 so obtained (that comprises at least the driving shuttle 21) from the remaining shuttles 21, 22, 23 of set 11, 12 (FIG. 12). In particular, the control unit of the bending machine 1 moves the set 11, 12 of shuttles 21, 22, 23 in a detaching position and activates a defined unlocking unit 35 in order to achieve a shuttle convoy 13, 14 that comprises a number of shuttles 21, 22, 23 carrying respective auxiliary tools 41, 42 which together forms the required auxiliary tool composition for bending the workpiece 50 according to the a defined bending length.

In the example of the figures that show the first set 11 of shuttles, the unlocking unit 35 that is closer to the main bending tool 2 acts on the locking element 33 of one intermediate shuttle 22 (the locking element 33 is moved in the unlocking position E) so that a first shuttle convoy 13 comprising the driving shuttle 21 and three intermediate shuttles 22 is separated from the remaining shuttles 22, 23 of the first set 11.

Figure 1:
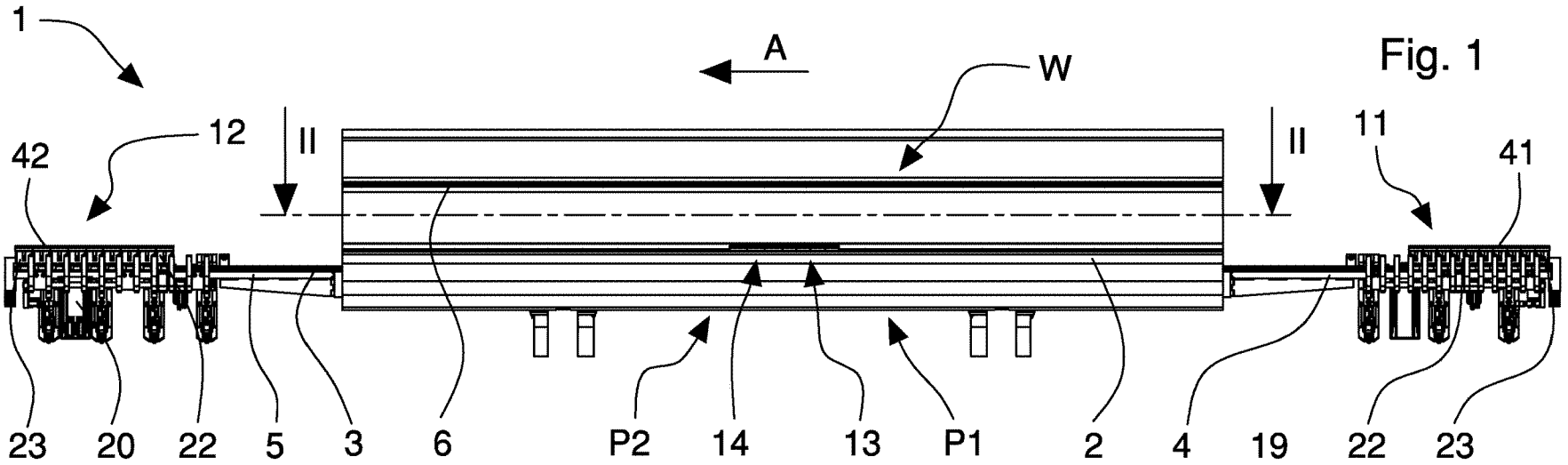
FIG. 1 is a schematic and partial front view of the bending machine according to the invention in an operative configuration.
Figure 2:
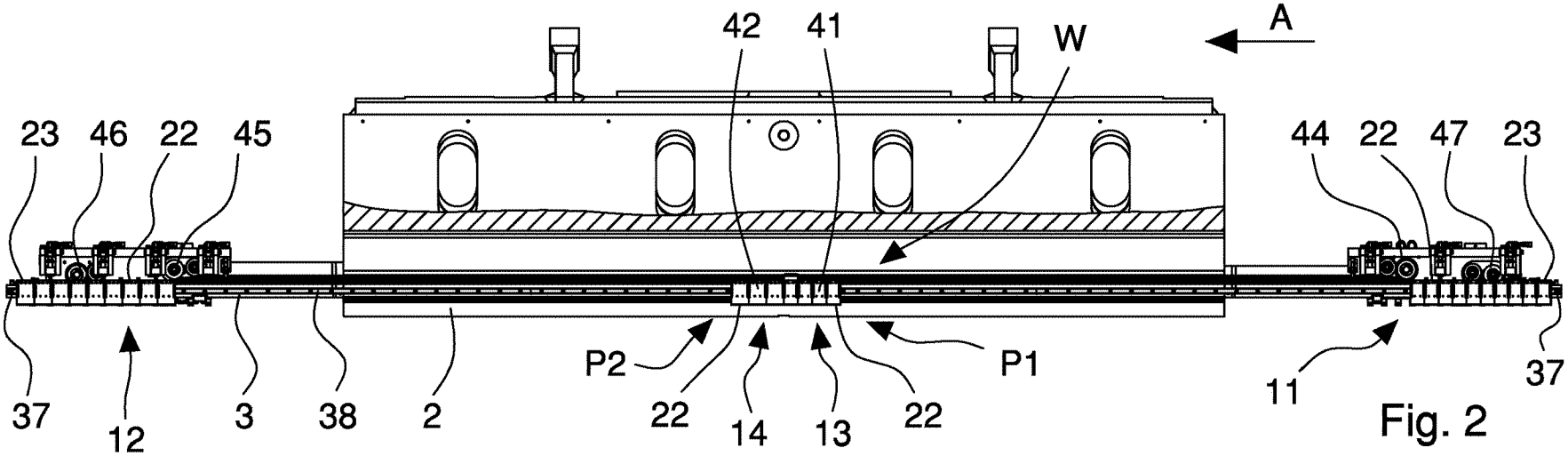
FIG. 2 is a longitudinal section according to line II-II of FIG. 1.
Figure 3:
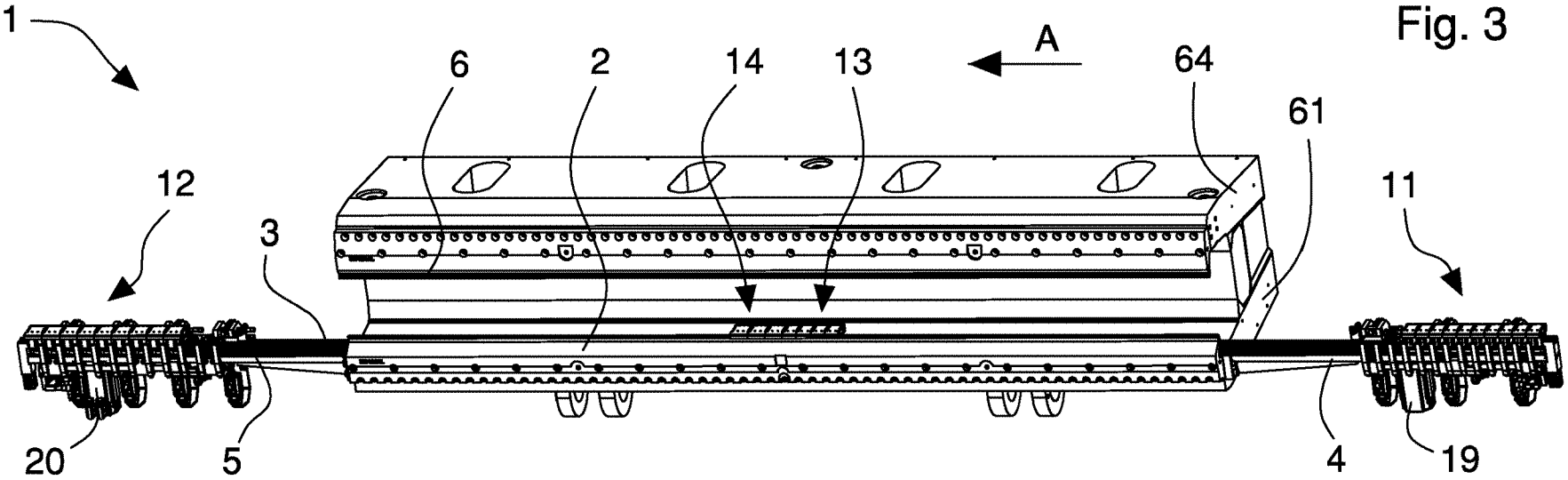
FIG. 3 is a perspective view of the machine of FIG. 1.
Figure 4:
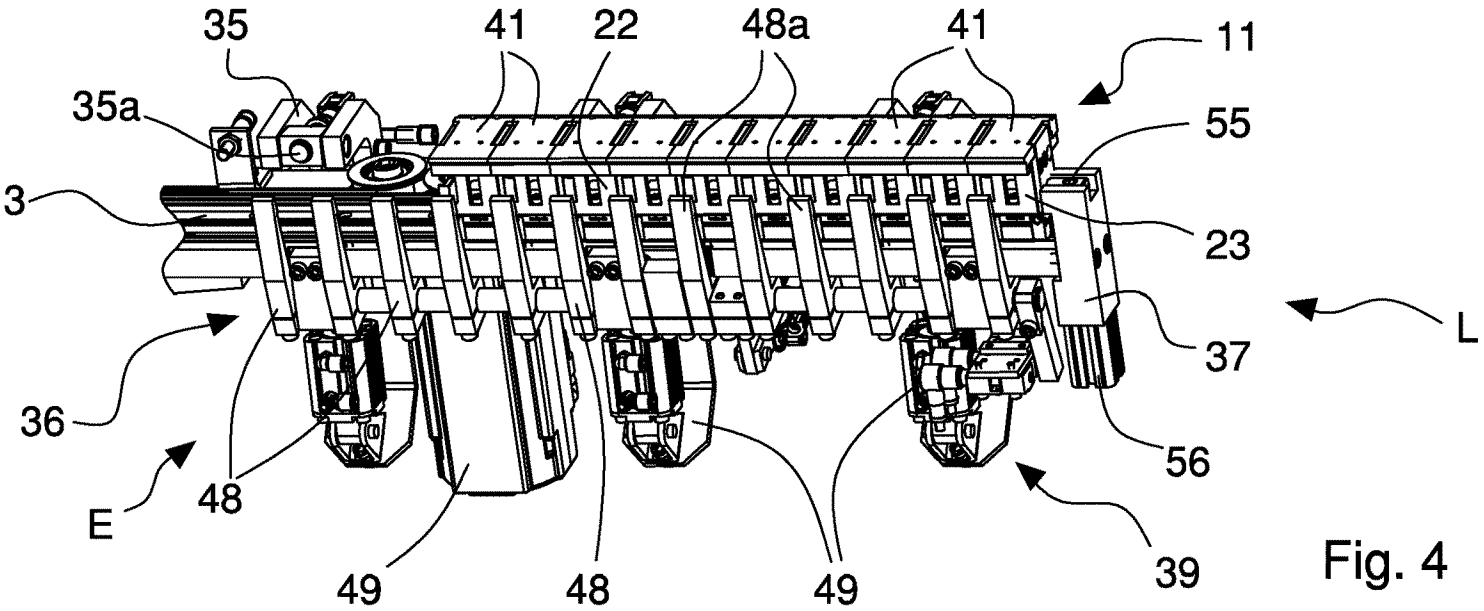
FIG. 4 is an enlarged detail of FIG. 3 showing a first set of shuttles carrying auxiliary tools.

Then the operative end 35*a* of the unlocking unit 35 is disengaged from the locking element 33 (FIG. 13) and the first shuttle convoy 13 (moved by driving system 15) pushes the remaining shuttles 22, 23 along the guide rail 3 towards the extremity of the first end portion 4 wherein the holding shuttle 23 can be engaged and blocked by the holding unit 37 (FIG. 14). With the remaining shuttles 22, 23 of the first set 11 fixed to the guide rail 3, the first shuttle convoy 13 is moved along the guide rail 3 (FIG. 15) inside the bending machine 1 in the working area W, so that the auxiliary tools 41 can be positioned on the lower bending tool 2 for bending the workpiece 50 along the required bending line (FIG. 1).

Figure 16:
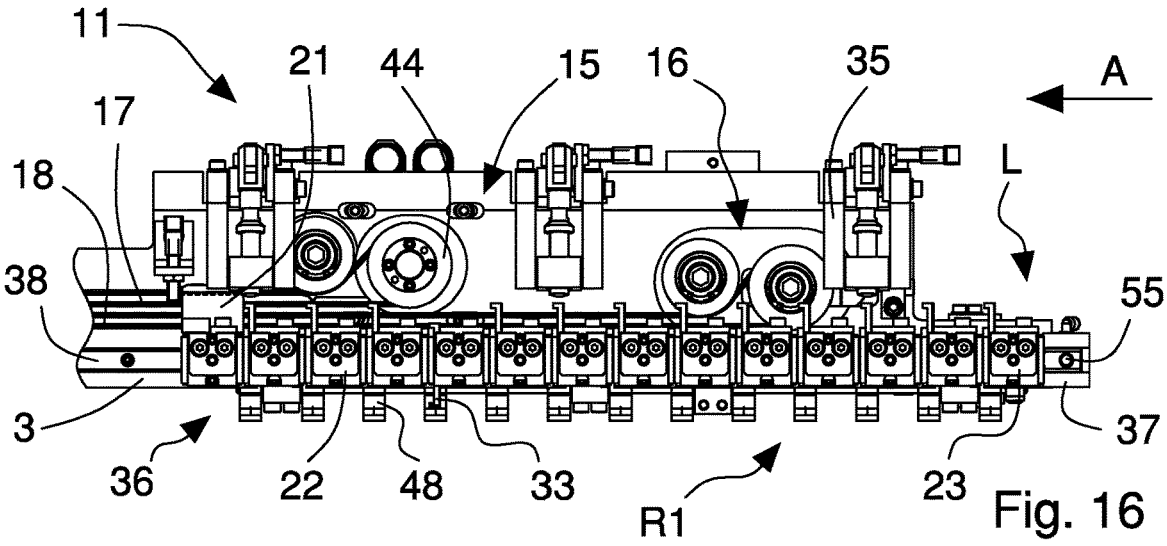
Figure 17:
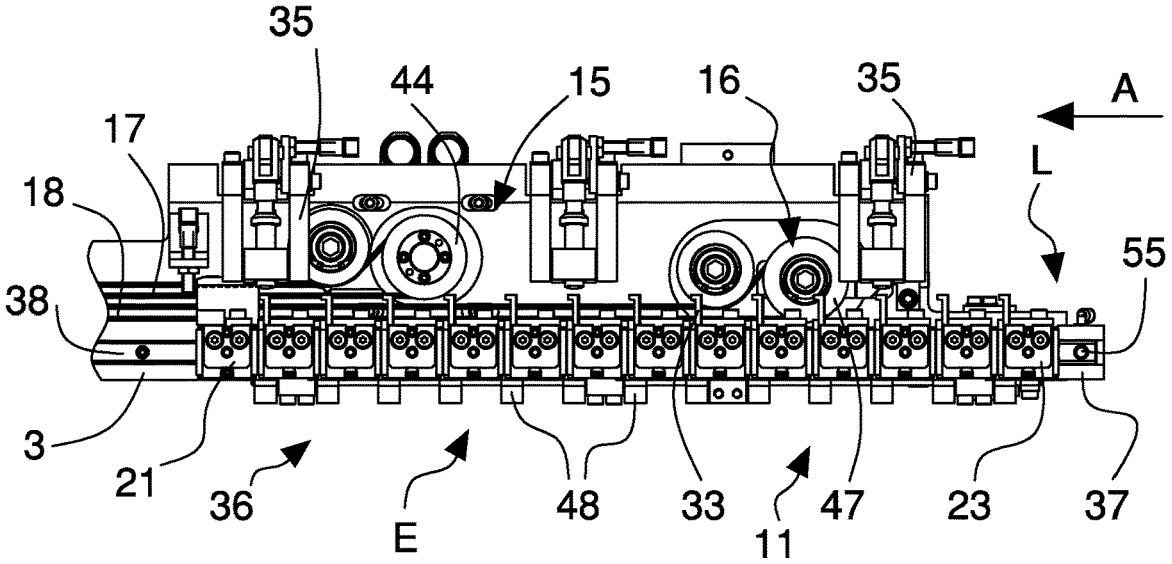

When partial bends have been carried out, the first shuttle convoy 13 is driven back from the working area W to the first end portion 4 of the guide rail 3 adjacent to the remaining shuttles 22, 23 of the first set 11 (FIG. 16). Then the locking unit 36 is activated in order to engage the connecting assembly of adjacent shuttles of the shuttle convoy and remaining shuttles respectively so as to connect together all the shuttles 21, 22, 23 of the first set 11 in the starting configuration. Specifically, the locking unit 36 with the corresponding lever 48 pushes the locking member 33 of the shuttle of the remaining shuttles that is adjacent to the first shuttle convoy 13 from the unlocking position E to the locking position D (FIGS. 17 and 18).

In another different operation cycle of the bending machine 1 a diverse composition of auxiliary tools 41, 42 can be arranged on the main bending tool 2 by making a different first shuttle convoy 13 comprising a number of shuttles 21, 22, 23 carrying respective auxiliary tools 41, 42 which together form such different auxiliary tool composition.

The same operation steps above described can be performed by the second set 12 of shuttles 21, 22, 23 that is positioned at the beginning of an operation cycle in a respective starting configuration wherein all the shuttles 21, 22, 23 are connected together and positioned at the second end portion 5 of the guide rail 3.

The composition of auxiliary tools 41, 42 to be mounted on the main bending tool 2 can be achieved by using a single shuttle convoy (the first shuttle convoy 13 carrying the first auxiliary tools 41 or the second shuttle convoy 14 carrying the second auxiliary tools 42) or using both shuttle convoys 13, 14 which, in this case, are positioned aligned side by side inside the bending machine 1.

In fact, a partial bend length can be carried out using a certain number of first auxiliary tool 41 having a first width or certain number of second auxiliary tools 42 having a second width or else using a combination of first auxiliary tools 41 and second auxiliary tools 42.

In the example shown in the figures, the first set 11 comprises fourteen shuttles 21, 22, 23 provided with the first auxiliary tools 41 having a first width equal to 40 mm, while the second set 12 comprises twelve shuttles 21, 22, 23 provided with the second auxiliary tools 42 having a second width equal to 50 mm.

The first set 11 of shuttles 21, 22, 23 allows having an auxiliary tool composition with a maximum length of 560 mm, while the second set 12 of shuttles 21, 22, 23 allows having an auxiliary tool composition having a maximum length of 600 mm. Therefore by combining the shuttles 21, 22, 23 of the different sets 11, 12 it is possible to make auxiliary tool compositions ranging between 40 mm and 1160 mm.

According to a variant of the bending machine 1 not shown in the figures, both first auxiliary tool 41 and second auxiliary tool 42 are mounted on the shuttles of same set 11, 12 with different combinations and arrangements.

According to another variant of the bending machine 1, further auxiliary tools having respective sizes can be provided and associated with the shuttles 21, 22, 23 in order to make different and specific auxiliary tool compositions.

The bending machine 1 of the invention allows automatically, quickly and precisely mounting on and/or dismounting from a main bending tool assembly 2 one or more auxiliary bending tools 41, 42 without requiring manual operations. In fact, the shuttles 21, 22, 23 carrying the auxiliary bending tools are moved and positioned along the guide rail 3 associated to the main bending tool 2 by the driving system 15, 16 that is controlled by the control unit of the bending machine 1. Furthermore, the composition of auxiliary tools 41, 42 to be mounted on the main bending tool 2 is achieved automatically by using a single shuttle convoy or both shuttle convoys 13, 14. In fact, a partial bend length can be carried out using one or more first auxiliary tool 41 having a first width and/or one or more second auxiliary tools 42 having a second width. In other words, according to the bending machine 1 of the invention it is possible to set up a desired length of the auxiliary bending tool composition by automatically selecting and arranging the shuttles 21, 22, 23 of the shuttle convoy 13, 14.

It should be noted that in the bending machine 1 of the invention the auxiliary tools 41, 42 can be both automatically and very quickly mounted/dismounted. Such automatic procedures require a short machine downtime and thus can be performed not only before starting the workpiece production cycle but also during the same production cycle. In other words, a production cycle comprising full length bends and partial bends on the same workpiece 50 can be performed by the bending machine 1 of the invention without reducing the machine output.

Guide 3, shuttles 21, 22, 23, driving system 15, 16, locking/unlocking units 35, 36 and holding devices 37 form a system for selecting and positioning the auxiliary bending tools 41, 42 that has simple and economical structure and an effective and reliable operation.

According to a further variant of the bending machine 1 not shown in the figures, the main bending tool assembly comprises the upper bending tool 6 and the guide comprises a guide rail 3 that is associated to said upper bending tool 6 and is coupled to and supported by the upper support 64 thereof. In this variant, the auxiliary bending tools 41, 42 carried by the shuttle convoys 13, 14 are mounted on the upper bending tool 6 for partially bending the workpiece according to a top-down movement.

According to a still further variant of the bending machine 1 not shown in the figures, the main bending tool assembly comprises both the lower bending tool 2 and the upper bending tool 6 and the guide comprises a guide rail 3 that is associated to said lower bending tool 2 and is coupled to and supported by the lower support 61 thereof and a further guide rail that is associated to said upper bending tool 6 and is coupled to and supported by the upper support 64. In this variant, respective auxiliary bending tools 41, 42 are carried by the shuttle convoys 13, 14 to be mounted on the lower bending tool 2 and respective tools 41, 42 are carried by further shuttle convoys to be mounted on the upper bending tool 6 for partially bending the workpiece according to bottom-up and top-down movements, respectively.

The invention claimed is:

1. A sheet metal bending machine comprising:

a main bending tool assembly that extends along a longitudinal direction and includes a working zone, said main bending tool assembly being movable so as to bend a workpiece located in the working zone;

a guide that is attached to said main bending tool assembly, said guide being parallel to said main bending tool assembly and extending through the working zone of said main bending tool assembly, and said guide including a first end portion and a second end portion opposite to said first end portion, at least said first end portion extending beyond said main bending tool assembly in the longitudinal direction;

shuttles that are slidably mounted on said guide; and auxiliary tools carried by said shuttles, said auxiliary tools each being configured to execute a bend on the workpiece, wherein said shuttles are movable in the longitudinal direction between a first active position, at which said shuttles are positioned at the working zone and said auxiliary tools are mounted on said main bending tool assembly, and a first inactive position, at which said shuttles are positioned at said first end portion of said guide at a location other than the working zone, wherein said shuttles comprise a first set of shuttles, wherein said auxiliary tools comprise a first set of auxiliary tools each being carried by a respective one of said first set of shuttles, wherein said shuttles of said first set of shuttles are mutually connectable to form a first shuttle convoy that has a selectable number of shuttles of said first set of shuttles, and wherein said first shuttle convoy is movable between the first inactive position and the first active position in order to mount a defined composition of said first set of auxiliary tools of said first shuttle convoy on said main bending tool assembly.

2. The sheet metal bending machine according to claim 1, wherein said auxiliary tools comprises a second set of auxiliary tools, said second end portion of said guide extends beyond said main bending tool assembly in the longitudinal direction, said shuttles comprise a second set of shuttles, each shuttle of said second set of shuttles carrying a respective one of said second set of auxiliary tools, said shuttles of said second set of shuttles being mutually connectable to form a second shuttle convoy that has a selectable number of shuttles of said second set of shuttles, and said second shuttle convoy is movable between a second active position, at which said second shuttle convoy is positioned at the working zone and said second set of auxiliary tools of said second shuttle convoy are mounted on said main bending tool assembly, and a second inactive position, at which said second shuttle convoy is positioned at said second end portion of said guide at a location other than the working zone.

3. The sheet metal bending machine according to claim 2, wherein said auxiliary tools of said first set of auxiliary tools have a first size and said auxiliary tools of said second set of auxiliary tools have a second size.

4. The sheet metal bending machine according to claim 2, further comprising a driving system coupled to at least one shuttle of said second set of shuttles, said driving system for moving said shuttles of said second set of shuttles along said guide.

5. The sheet metal bending machine according to claim 4, wherein said driving system comprises an actuator device and driving belts that are connected to said at least one shuttle of said second set of shuttles, said actuator device being operable to move said driving belts.

6. The sheet metal bending machine according to claim 4, further comprising holding devices that are fixed to said guide at said second end portion and arranged for locking at least one shuttle of said second set of shuttles to said guide, wherein said second set of shuttles comprises a holding shuttle, a driving shuttle, and at least one intermediate shuttle located between said holding shuttle and said driving shuttle, said holding shuttle is engagable by said holding devices so as to be locked to said guide, and said driving shuttle is coupled to said driving system so as to be moved along said guide.

7. The sheet metal bending machine according to claim 2, wherein each of said shuttles comprises a connecting assembly for engaging or disengaging a respective connecting assembly of an adjacent shuttle so as to mutually connect or disconnect said shuttles and form said second shuttle convoy.

8. The sheet metal bending machine according to claim 7, further comprising locking/unlocking units fixed to said guide, said locking/unlocking units configured to selectively act on said connecting assemblies of said shuttles for connecting or disconnecting said shuttles, wherein said connecting assemblies each comprise a connecting pin that protrudes from a side of a respective one of said shuttles, a connecting cavity located at an opposite side of said respective one of said shuttles and arranged for receiving a connecting pin of an adjacent shuttle, and a locking element that is slidably associated to said connecting cavity and selectively movable so as to engage or disengage said connecting pin of said adjacent shuttle when said connecting pin of said adjacent shuttle is inserted in said connecting cavity, said locking element being movable by said locking/unlocking units.

9. The sheet metal bending machine according to claim 1, further comprising a driving system coupled to at least one shuttle of said first set of shuttles, said driving system for moving said shuttles of said first set of shuttles along said guide.

10. The sheet metal bending machine according to claim 9, wherein said driving system comprises an actuator device and driving belts that are connected to said at least one shuttle of said first set of shuttles, said actuator device being operable to move said driving belts.

11. The sheet metal bending machine according to claim 9, further comprising holding devices that are fixed to said guide at said first end portion and arranged for locking at least one shuttle of said first set of shuttles to said guide, wherein said first set of shuttles comprises a holding shuttle, a driving shuttle, and at least one intermediate shuttle located between said holding shuttle and said driving shuttle, said holding shuttle is engagable by said holding devices so as to be locked to said guide, and said driving shuttle is coupled to said driving system so as to be moved along said guide.

12. The sheet metal bending machine according to claim 11, wherein said first shuttle convoy comprises at least said driving shuttle.

13. The sheet metal bending machine according to claim 1, wherein each of said shuttles comprises a connecting assembly for engaging or disengaging a respective connecting assembly of an adjacent shuttle so as to mutually connect or disconnect said shuttles and form said first shuttle convoy.

14. The sheet metal bending machine according to claim 13, further comprising locking/unlocking units fixed to said guide, said locking/unlocking units configured to selectively act on said connecting assemblies of said shuttles for connecting or disconnecting said shuttles.

15. The sheet metal bending machine according to claim 14, wherein said connecting assemblies each comprise a connecting pin that protrudes from a side of a respective one of said shuttles, a connecting cavity located at an opposite side of said respective one of said shuttles and arranged for receiving a connecting pin of an adjacent shuttle, and a locking element that is slidably associated to said connecting cavity and selectively movable so as to engage or disengage said connecting pin of said adjacent shuttle when said connecting pin of said adjacent shuttle is inserted in said connecting cavity, said locking element being movable by said locking/unlocking units.

16. The sheet metal bending machine according to claim 1, further comprising holding devices that are fixed to said guide at said first end portion and arranged for locking at least one shuttle of said first set of shuttles to said guide.

17. The sheet metal bending machine according to claim 1, wherein said auxiliary tools have different sizes.

18. The sheet metal bending machine according to claim 1, wherein said main bending tool assembly comprises at least one of a lower bending tool that is arranged for contacting a first surface of the workpiece and an upper bending tool that is arranged for contacting a second surface of the workpiece that is opposite said first surface of the workpiece.

19. The sheet metal bending machine according to claim 18, wherein said guide comprises a guide rail that is coupled to said lower bending tool or to said upper bending tool.

20. The sheet metal bending machine according to claim 19, wherein said guide comprises a further guide rail that is coupled to said upper bending tool or to said lower bending tool, said shuttles comprise at least one further set of shuttles that are slidably mounted on said further guide rail and support respective auxiliary tools of said auxiliary tools, and said shuttles of said further set of shuttles are mutually connectable to form a further shuttle convoy that has a selectable number of shuttles of said at least one further set of shuttles.

* * * * *